US005957748A

United States Patent [19]

Ichiha

[11] Patent Number: 5,957,748

[45] Date of Patent: Sep. 28, 1999

[54] WOMEN'S CLOTHING

[75] Inventor: Hideki Ichiha, Tokyo, Japan

[73] Assignee: Triumph International (Japan), Ltd., Tokyo, Japan

[21] Appl. No.: 08/987,821

[22] Filed: Dec. 10, 1997

[30] Foreign Application Priority Data

Dec. 13, 1996 [JP] Japan ..... 8-333834

[51] Int. Cl.[6] ..... A41D 3/02

[52] U.S. Cl. ..... 450/58; 450/36; 450/88; 24/573.1

[58] Field of Search ..... 450/58, 36, 88, 450/72, 82; 2/73, 69, 105, 106, 115, 113, 114, 336; 24/573.1, 615, 616, 632, 633, 580, 581, 582, 583, 584, 585

[56] References Cited

U.S. PATENT DOCUMENTS

| | | | |
|---|---|---|---|
| 2,495,667 | 1/1950 | Vizner | 24/580 |
| 3,040,750 | 6/1962 | Hurwitz . | |
| 5,380,238 | 1/1995 | Crew-Gee | 450/36 |
| 5,427,562 | 6/1995 | Hwang | 450/53 |

FOREIGN PATENT DOCUMENTS

| | | |
|---|---|---|
| UM57-74914 | 5/1982 | Japan . |
| UM62-112304 | 7/1987 | Japan . |
| UM4-17523 | 4/1992 | Japan . |
| UM6-37309 | 5/1994 | Japan . |
| UM7-31810 | 6/1995 | Japan . |

*Primary Examiner*—Gloria Hale
*Attorney, Agent, or Firm*—Brinks Hofer Gilson & Lione

[57] ABSTRACT

Women's clothing has a slidable adjuster A provided between left and right breast cup portions (1, 1'). The adjuster A comprises an outer casing (10) and sliding portions (20). The wearer can change the positions of engagement between first engaging portions (12) provided in the outer casing (10) and second engaging portions (20) provided in the sliding portions (20) by operating the sliding portions (20), so that the distance between the breast cup portions (1, 1') can be adjusted to a desired level either when the clothing is being put on or after the clothing is put on.

12 Claims, 5 Drawing Sheets

WOMEN'S CLOTHING

BACKGROUND OF THE INVENTION

The present invention relates to a new women's clothing having breast cup portions. More particularly, the present invention is concerned with women's clothing having an adjuster for finely adjusting the distance between a pair of left and right breast cup portions. The present invention is also concerned with the above-mentioned adjuster.

The contents of Application No.8-333834, filed on Dec. 13, 1996 in Japan is hereby incorporated by reference.

In recent years, women's clothing which has breast cup portions, in particular brassieres, is required to be capable of not only covering the breasts but also providing comfort during wear while creating a beautiful bust line.

In conventional women's clothing having breast cup portions, the circumference of the underbust can be roughly adjusted to a few positions by means of a hook provided in the back. However, the distance between the two cup portions is fixed and it has been impossible for the wearer to make fine adjustments in accordance with her own bust shape. On the other hand, with respect to a so-called front hook type brassiere, the brassiere can be fastened and unfastened by means of a hook provided between the breast cup portions, but the hook is provided at predetermined fixed distances from the respective breast cup portions, making it impossible to change the distance between the cup portions. In fact, however, bust shape and the distance between the left and right breasts differ greatly from one woman to another, and it has been desired to develop women's clothing having breast cup portions, such as a general-purpose front hook type brassiere, which is adjustable to fit all users.

SUMMARY OF THE INVENTION

In view of the above, it is an object of the present invention to provide a new women's clothing having an adjuster between the left and right breast cup portions, which adjuster enables the wearer to finely adjust the distance between the two cup portions according to her own bust shape either when the clothing is being put on or after the clothing is put on.

It is another object of the present invention to provide the above-mentioned new adjuster.

In one aspect of the present invention, there is provided a new women's clothing having a pair of left and right breast cup portions for covering the breasts, wherein a new adjuster is provided between the breast cup portions for adjusting the distance between the breast cup portions, the adjuster comprising: an outer casing; sliding portions contained in the outer casing and engagable with the outer casing in a stepwise manner; engagement maintaining means for maintaining engagement between the sliding portions and the outer casing; and disengaging means for bringing the sliding portions and the outer casing out of engagement.

In the above-mentioned women's clothing, since the new adjuster is provided between the left and right breast cup portions, the wearer can easily and finely adjust the distance between the breast cup portions either when the clothing is being put on or after the clothing is put on.

It is preferable for the outer casing to have first engaging portions engagable with the sliding portions in a stepwise manner, and for the sliding portions to comprise sliding portion bodies contained in the outer casing and second engaging portions provided in the sliding portion bodies, the second engaging portions being engagable with the first engaging portions in a stepwise manner. The wearer can easily adjust the distance between the breast cup portions by operating the sliding portions.

It is also preferable for the engagement maintaining means to be provided in the outer casing and to be deformable between an operating position and a non-operating position, the engagement maintaining means being adapted to press, at the operating position, the first engaging portions and the second engaging portions thereby maintaining engagement therebetween and keeping, at the non-operating position, the first engaging portions and the second engaging portions away from each other, and for the disengaging means to be provided outside the outer casing and movable so as to allow deformation of the engagement maintaining means between the operating position and the non-operating position. Normally, by the engagement maintaining means, engagement between the first engaging portions and the second engaging portions are maintained and the sliding portions are maintained in the outer casing. The wearer operates the disengaging means provided outside the outer casing, as desired, to deform the engagement maintaining means at the non-operating position, thereby bringing the first engaging portions and the second engaging portions out of engagement, so that the sliding portions become slidable.

It is further preferable for the sliding portions to comprise a pair of sliding portion bodies connected to the pair of left and right breast cup portions, respectively. When the sliding portions comprise a pair of left and right sliding portion bodies, the distance between the cup portions can be adjusted by moving both sliding portion bodies so that they are located at the same distances from the center of the wearer's body, respectively, or by moving either one of the sliding portion bodies.

The women's clothing may be such as further comprises an inter-cup engaging portion for disengagably engaging the pair of left and right breast cup portions with each other, in which the adjuster is provided in the inter-cup engaging portion. In this instance, the inter-cup distance can be adjusted while performing engagement between the breast cup portions by means of the inter-cup engaging portion, so that the women's clothing can be put on easily without the need for performing engagement between the breast cup portions in the back.

Further, the women's clothing may be such as further. comprises back engaging portions provided in the back that are capable of rough adjustment, in which the, adjuster is capable of finely adjusting the distance between the breast cup portions either when the clothing is being put on or after the clothing is put on. It is preferable for each of the sliding portions to have a stopper at a leading end portion thereof so as to prevent separation of the sliding portions from the outer casing. When the women's clothing not only has the adjuster provided between the breast cup portions but also has the back engaging portions, the distance between the cup portions can be adjusted within a wide range, so that the women's clothing easily fits the wearer.

The second engaging portions of the pair of sliding portion bodies in engagement with the first engaging portions of the outer casing may be simultaneously or individually brought out of engagement by the disengaging means. It is preferable for the disengaging means to be a pressing member which covers the outer casing. When the second engaging portions are simultaneously brought out of engagement, it is preferable for the disengaging means to comprise a single pressing member. When the second engaging portions are individually brought out of engagement, it is preferable for the disengaging means to comprise at least two pressing members, from the viewpoint of operability.

In the women's clothing of the present invention having a new adjuster provided between the left and right breast cup portions, the wearer can finely adjust the distance between the cup portions, which is fixed in conventional women's clothing, either when the clothing is being put on or the clothing is put on, so that the wearer can move the breast cup portions to a "good fit" position in accordance with her own bust shape. Therefore, the women's clothing of the present invention provides a good fit and comfort for the wearer. If desired, the distance between the breast cup portions can be reduced so that the left and right breasts are brought close enough to the center of the bust to provide an excellent "push-up" effect.

In another aspect of the present invention, there is provided an adjuster for adjusting the distance between a pair of left and right breast cup portions, comprising: an outer casing; sliding portions contained in the outer casing and engagable with the outer casing in a stepwise manner; engagement maintaining means for maintaining engagement between the sliding portions and the outer casing; and disengaging means for bringing the sliding portions and the outer casing out of engagement.

It is preferable for the outer casing to have first engaging portions engagable with the sliding portions in a stepwise manner, and for the sliding portions to comprise sliding portion bodies contained in the outer casing and second engaging portions provided in the sliding portion bodies, the second engaging portions being engagable with the first engaging portions in a stepwise manner. Further, it is preferable for the engagement maintaining means to be provided in the outer casing and to be deformable between an operating position and a non-operating position, the engagement maintaining means being adapted to press, at the operating position, the first engaging portions and the second engaging portions thereby maintaining engagement therebetween and keeping, at the non-operating position, the first engaging portions and the second engaging portions away from each other, and for the disengaging means to be provided outside the outer casing and movable so as to allow deformation of the engagement maintaining means between the operating position and the non-operating position.

Further, it is preferable for either the first engaging portions or second engaging portions to comprise a plurality of engaging ribs and for the second engaging portions or the first engaging portions to engage either one of the ribs such that the positions of engagement between the first engaging portions and the second engaging portions are adjusted between positions for holding the inter-cup distance at a maximum and positions for holding the inter-cup distance at a minimum.

Further, it is preferable for the sliding portions to comprise a pair of sliding portion bodies connected to the pair of left and right breast cup portions, respectively: for the disengaging means to be a pressing member which covers the outer casing; and for a pair of second engaging portions in engagement with the first engaging portions to be simultaneously or individually brought out of engagement by the disengaging means.

It is preferable for the first engaging portions and. the second engaging portions to be capable of being disengaged by the application of a very small force, thereby ensuring that the sliding portions can be easily slide inward of the outer casing but for the first and second engaging portions not to be capable of being readily disengaged unless the disengaging means is actuated if the sliding portions are to be slid outward of the outer casing. To meet these requirements, it is preferable for either first engaging portions or second engaging portions to be shaped such that the side facing the interior of the outer casing is tapered, whereas the opposite side is made vertical.

It is preferable for the disengaging means to be a pressing member which covers the outer casing, from the viewpoint of improving an appearance and operability. When the pressing member covers the outer casing, not only can a good appearance be obtained, but also disengagement for adjusting the distance between the cup portions can be easily performed by the wearer by pushing the pressing member with fingers.

DESCRIPTION OF THE PREFERRED EMBODIMENTS

Hereinbelow, preferred embodiments of the present invention are described in detail, with reference to the accompanying drawings. However, the present invention is not limited to those embodiments. Although the following description primarily concerns a brassiere, the present invention is not limited to brassieres but can be applied to all articles of women's clothing having breast cup portions.

Figure 1:
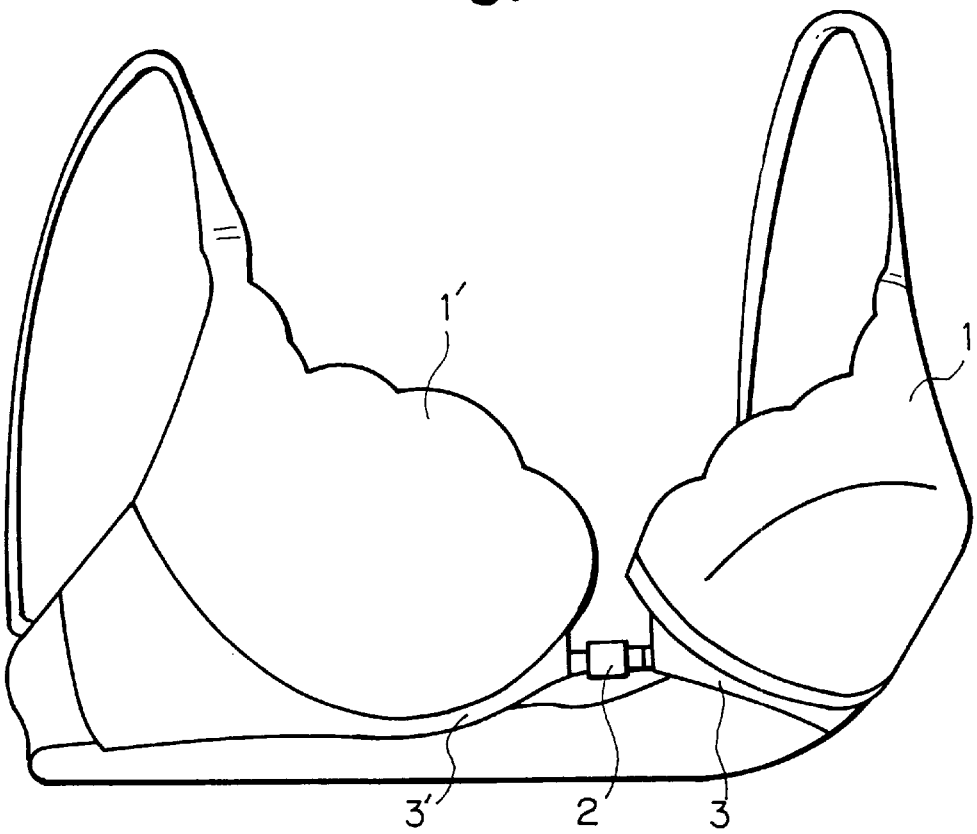
FIG. 1 is a perspective view of a brassiere according to one embodiment of the present invention.
Figure 2:
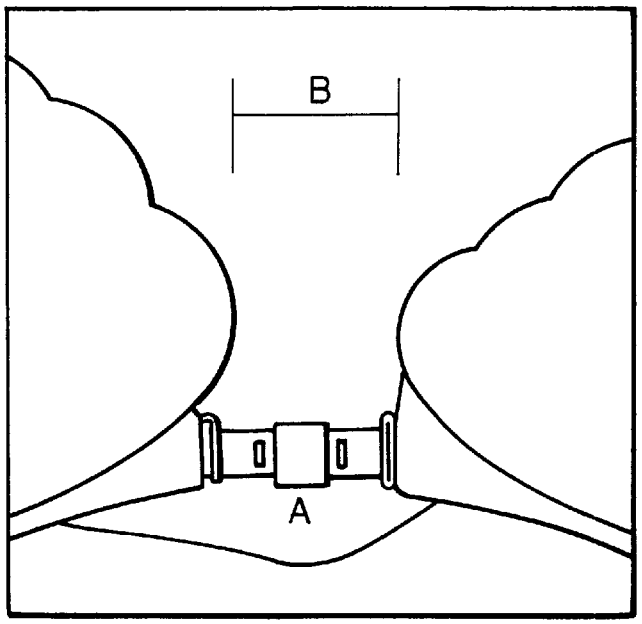
FIG. 2 is an enlarged perspective view of a part of the brassiere of FIG. 1, in which a pair of sliding portions are extended to a maximum length.
Figure 3:
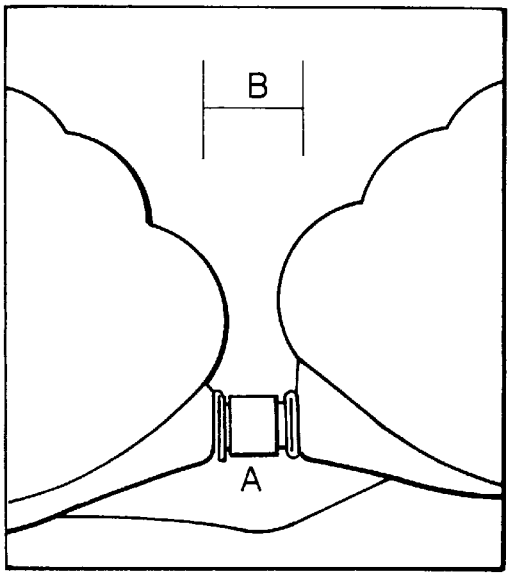
FIG. 3 is another enlarged perspective view of a part of the brassiere of FIG. 1, in which a pair of sliding portions are contracted to a minimum length.
Figure 4:
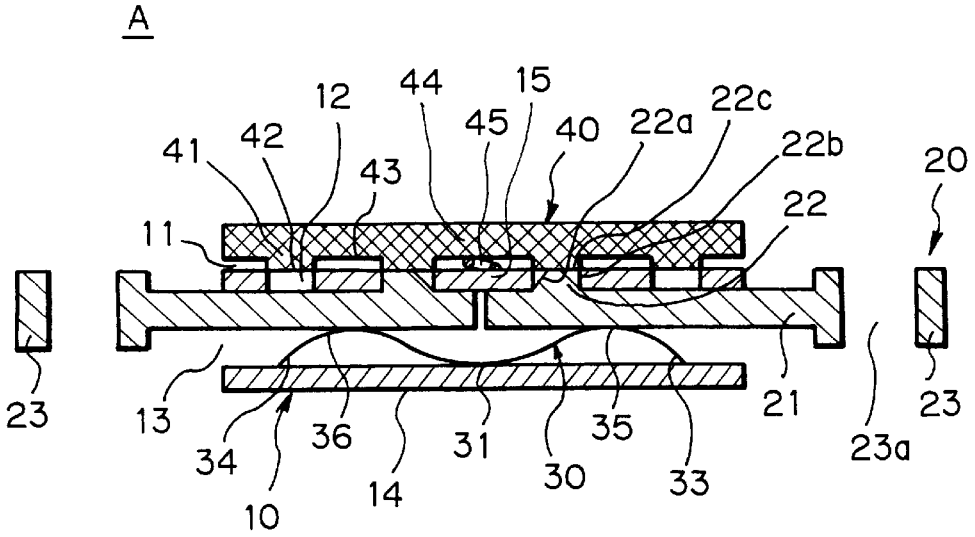
FIG. 4 is a cross-sectional view of an adjuster A according to one embodiment of the present invention.

FIG. 1 is a perspective view of a brassiere as women's clothing according to one embodiment of the present invention. FIG. 2 is an enlarged perspective view of a part of the brassiere of FIG. 1, in which a pair of sliding portions are extended to a maximum length. FIG. 3 is another enlarged perspective view of a part of the brassiere of FIG. 1, in which a pair of sliding portions are contracted to a minimum length. FIG. 4 is a cross-sectional view of an adjuster A according to one embodiment of the present invention. FIG.

Figure 6:
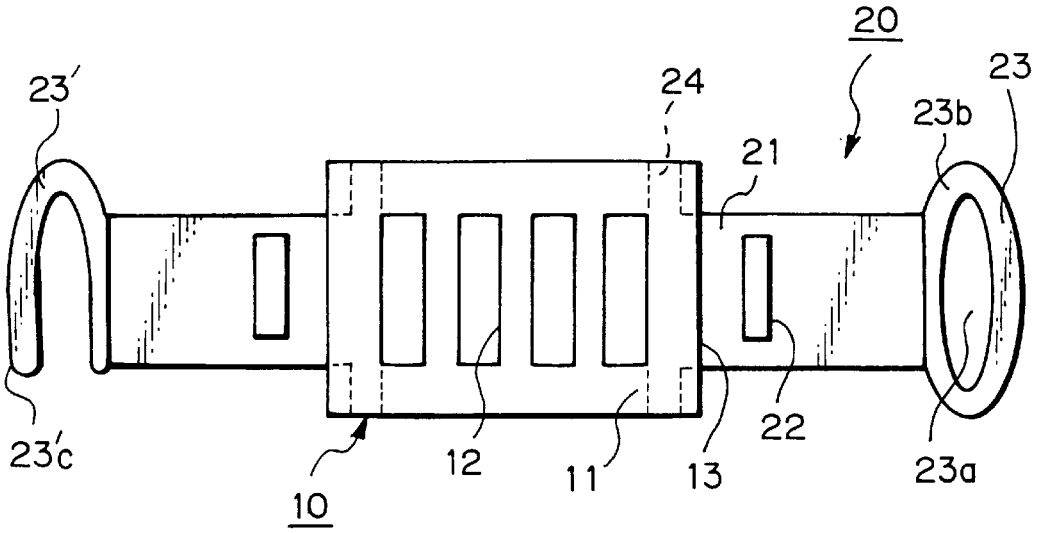
FIG. 6 is a general plan view of the outer casing and the sliding portions of the adjuster A, in which the sliding portions are extended to a maximum length with the disengaging means being removed.

5 is a perspective view of a sliding portion of the adjuster A of FIG. 4. FIG. 6 is a general plan view of the outer casing and the sliding portions of the adjuster A, in which the sliding portions are extended to a maximum length with the disengaging means being removed.

The brassiere shown in FIGS. 1 to 6 has no back engaging portions but has an inter-cup engaging portion between the breast cup portions. As shown in FIG. 1, the brassiere comprises a pair of left and right breast cup portions 1, 1', under cup pieces 3, 3' and an inter-cup engaging portion 2 for disengagably engaging the breast cup portions 1, 1' with each other through the under cup pieces 3, 3'. An adjuster A is provided in the inter-cup engaging portion 2 for adjusting the distance between the left and right breast cup portions 1, 1' (hereinafter, referred to simply as "inter-cup distance"). FIG. 2 and FIG. 3 show a maximum inter-cup distance and a minimum inter-cup distance which can be achieved by operating the adjuster A, respectively.

Figure 5:
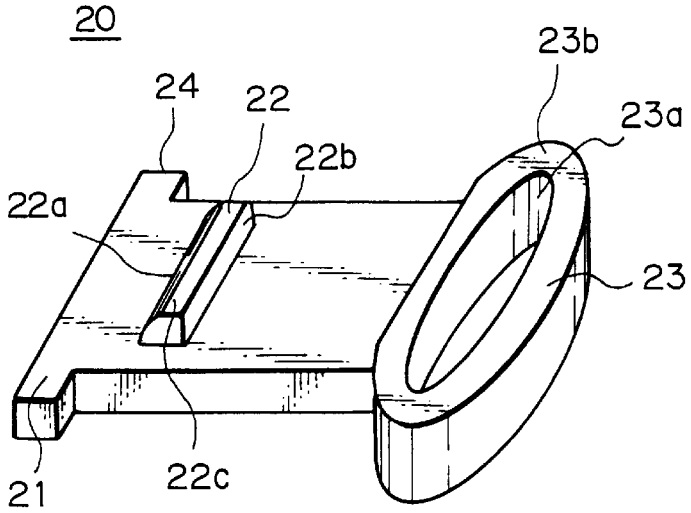
FIG. 5 is a perspective view of a sliding portion of the adjuster A of FIG. 4.

With respect to the adjuster A, explanation is made in detail, with reference to FIGS. 4 to 6. The adjuster A comprises an outer casing 10, sliding portions 20 contained in the outer casing 10 and engagable with the outer casing 10 in a stepwise manner, engagement maintaining means 30 for maintaining engagement between the sliding portions 20 and the outer casing 10, and disengaging means 40 for bringing the sliding portions 20 and the outer casing 10 out of engagement.

The outer casing 10 has first engaging portions 12 engagable with the sliding portions 20 in a stepwise manner. The outer casing 10 is shaped as a hollow box having a front 11 (an upper portion as viewed in FIG. 4), a back 14 (a lower portion as viewed in FIG. 4) and lateral sides 13, each provided with an opening through which the sliding portion 20 can be slid into or out of the outer casing 10.

A plurality of first engaging portions 12 are provided in the front 11 of the outer casing 10. Each of the first engaging portions 12 is shaped as an opening having a width sufficient for enabling a second engaging portion provided in the sliding portions 20 (explained below in detail) to be fitted therein. In the embodiment shown in FIG. 4, the first engaging portions 12 are disposed by twos in the left direction and the right direction, relative to the center of the front 11, such that the resultant four first engaging portions 12 are disposed at the same intervals. However, the number of the first engaging portions 12 and the intervals at which they are disposed can be determined without any particular limitation, depending on various factors, such as the type and size of women's clothing provided with the adjuster A.

The sliding portions 20 comprise sliding portion bodies 21 contained in the outer casing 10 and second engaging portions 22 provided in the sliding portion bodies 21 and engagable with the first engaging portions 12 in a stepwise manner. Each of the sliding portion bodies 21 is shaped as a plate which can be slid inward of the outer casing 10 through the opening provided in the lateral side 13. Each of the sliding portion bodies 21 has provided at a leading end portion thereof (as viewed in a direction of sliding the sliding portion body 21 inward of the outer casing 10) an extended portion 24 which has projections on both sides thereof. The extended portions 24 serve as stoppers. That is, as indicated by broken lines in FIG. 6, the projections of the extended portions 24 engage the respective walls of the lateral sides 13 of the outer casing 10, thereby preventing complete separation of the sliding portion bodies 21 from the outer casing 10. On the other hand, connecting portions 23, 23' are integrally formed with the sliding portion bodies 21 at tailing end portions (leading end portions as viewed in a direction of sliding the sliding portion bodies 21 outward of the outer casing 10) thereof. The connecting portions 23, 23' are adapted to be connected to the breast cup portions 1, 1' or the under cup pieces 3, 3'. Both connecting portions 23, 23' have a flat form. The connecting portion 23 is shaped as a closed ring having a central opening 23*a*, and can be connected to the breast cup portion 1 or the under cup piece 3 by a conventional method, such as sewing. The connecting portion 23' is U-shaped, having an open lower end portion 23'*c*. The lower end portion 23'*c* is adapted to engage, for example, a loop (not shown) provided in the breast cup portion 1' or the under cup piece 3'.

Each of the sliding portion bodies 21 has the above-mentioned second engaging portion 22 integrally formed therewith in the form of a projection near the leading end portion of the sliding portion body 21. The second engaging portion 22 is adapted to be fitted into either one of the first engaging portions (i.e., the openings 12). In this embodiment of the present invention, each of the sliding portion bodies 21 has a single second engaging portion 22. However, each of the sliding portion bodies 21 may have a plurality of second engaging portions 22. As shown in FIGS. 4 and 5, the second engaging portion 22 has a tapered surface 22*a* which is tapered toward the leading end portion of the sliding portion body 21; a vertical surface 22*b* facing the tailing end portion of the sliding portion body 21; and a plane front surface 22*c*. The distance between the tapered surface 22*a* and the vertical surface 22*b* at the lower end of the second engaging portion 22 is substantially equal to the width of the opening 12, and the width of the plane front surface 22*c* is smaller than that of the opening 12. The height of the second engaging portion 22 is equal to the depth of the opening 12 so that when the second engaging portion 22 engages the first engaging portion 12, the front surface 22*c* does not protrude from the opening 12. The second engaging portions 22 having the above-mentioned configuration can be smoothly slid inward of the outer casing 10 when the sliding portions 20 are inserted into the outer casing 10. Once the second engaging portion 22 is fitted in one of the first engaging portions 12, since the vertical surface 22*b* engages a wall surface of the first engaging portion 12, the sliding portions 20 are not unexpectedly pulled out.

The above-mentioned engagement maintaining means 30 is provided in the outer casing 10 and deformable between an operating position and a non-operating position. At the operating position, the engagement maintaining means 30 presses the first engaging portions 12 and the second engaging portions 22 to thereby maintain engagement therebetween. At the non-operating position, the engagement maintaining means 30 keeps the first engaging portions 12 and the second engaging portions 22 away from each other. In this embodiment, as shown in FIG. 4, the engagement maintaining means 30 is a leaf spring provided between the back 14 of the outer casing 10 and the sliding engaging portion bodies 21. The leaf spring 30 forms two symmetrical curves 35 and 36, relative to the central portion 31 thereof and is connected to the back 14 of the outer casing 10 at the central portion 31. The leaf spring 30 is an elastic article which contacts with the back surfaces of the sliding portion bodies 21 at the symmetrical curves 35 and 36, thereby pressing the sliding portion bodies 21 while being pressed by the disengaging means 40 through the sliding portion bodies 21. Both end portions 33 and 34 of the engagement maintaining means 30 contact with the back 14 of the outer casing 10 at two different positions such that the distance between those two different positions is shorter than the length of the back 14, and are adapted to bend according to a pressure from the sliding portion bodies 21. The leaf spring 30 has a length such that when the end portions 33 and 34 bend to a maximum degree, the leaf spring 30 extends substantially straight so that the end portions 33 and 34 reach both ends of the back 14 of the outer casing 10, respectively. The central portion of the back 14 includes a connecting portion (not shown) for connecting the central portion 31 of the leaf spring 30 to the central portion of the back 14 by fitting. However, the central portion 31 may be connected to the central portion of the back 14 by a connecting means which is conventionally employed. In order to enable the end portions 33 and 34 of the leaf spring 30 to smoothly move on the back 14, a leaf spring guiding groove (not shown) is provided in the back 14. In the present invention, the operating position (at which the disengaging means presses the first engaging portions and the second engaging portions thereby maintaining engagement therebetween) means a position such that the end portions 33 and 34 of the leaf spring 30 are located at their initial positions and the curve 35 (between the central portion 31 and the end portion 33) and the curve 36 (between the central portion 31 and the end portion 34) press the back surfaces of the sliding portion bodies 21 (FIG. 4). In this instance, the second engaging portions 22 are maintained at a state such that they are fitted in the first engaging portions (i.e., the openings 12) in the front 11 of the outer casing 10. On the other hand, the non-operating position herein means a position such that the leaf spring 30 is extended substantially straight by moving the end portions 33 and 34 of the leaf spring 30 within the leaf spring guiding groove in the back 14 of the outer casing 10. In this instance, the second engaging portions 22 in engagement with the first engaging portions 12 are brought out of engagement by the disengaging means 40 (explained below in detail). The engagement maintaining means 30 is required to apply a pressure sufficient for preventing unexpected separation of the second engaging portions 22 from the first engaging portions 12. However, the engagement maintaining means 30 does not need to be a strong leaf spring. A weak leaf spring which enables the wearer to easily disengage the first engaging portions 12 and the second engaging portions 22 by operating the disengaging means 40 is preferred. A synthetic resin material having suitable elasticity, such as a urethane foam, can be used as a material for the engagement maintaining means 30. When the engagement maintaining means 30 made of. a synthetic resin is used, the back 14 of the outer casing 10 may have a plane surface, and the engagement maintaining means 30 can be connected to the back 14 by, for example, conventional adhering means.

The disengaging means 40 is a pressing member 40 provided outside the outer casing 10, which fully covers a body of the outer casing 10 and is adapted to move to enable the engagement maintaining means 30 to deform between the operating position and the non-operating position. The pressing member 40 is shaped as a plate having a front surface 42 and a back surface 43. The front surface 42 is a surface which is seen from the outside when the brassiere is put on. The back surface 43 has projections 41 of the same number as that of the openings 12, each having a size corresponding to the size of the opening 12, provided at positions corresponding to the positions of the openings 12 provided in the front 11 of the outer casing 10. An elastic member 44 is disposed between the back surface 43 of the pressing member 40 and the front 11 of the outer casing 10. In order to deform the engagement maintaining means 30 at the operating position, that is, in order to maintain engagement between the first engaging portions and the second engaging portions, the pressing member 40 is maintained at a position separated from the outer casing 10 by a distance such that no projections 41 in the pressing member 40 are fitted in the openings 12 in the outer casing 10. On the other hand, in order to deform the engagement maintaining means 30 at the non-operating position, that is, in order to disengage the first engaging portions 12 and the second engaging portions 22, the projections 41 are fitted in the openings 12 by pushing the pressing member 40. In FIG. 4, a spring 44 as the elastic member 44 is provided between a central portion 45 of the back surface 43 of the pressing member 40 and a central portion 15 of the front 11 of the outer casing 10. However, in the present invention, the elastic member 44 is not limited to a spring. A synthetic resin article can also be used, as long as it has elasticity. With respect to the position of the elastic member 44, there is no particular limitation, as long as the elastic member 44 is provided between the back surface 43 of the pressing member 40 and the front 11 of the outer casing 10. The elastic member 44 may be provided on a portion of the back surface 43 or over the entire surface of the back surface 43, exclusive of the projections 41.

When the disengaging means 40 is formed from a single plate as shown in FIG. 4, the first engaging portions 12 in engagement with the second engaging portions; 22 of the left and right sliding portion bodies 21 as the sliding portions 20 are simultaneously brought out of engagement. When the disengaging means 40 is formed from a pair of left and right plates corresponding to the left and right sliding portion bodies 21 and an elastic member 44 is provided on each of the left and right plates, the first engaging portions 12 in engagement with the second engaging portions 22 of the left and right sliding portion bodies 21 are individually brought out of engagement.

With respect to the type of materials used for the adjuster A, it is preferred to use a material which has sufficient stiffness to withstand repeated use but which is not rough to the touch. Polyacetal type plastics, such as Duracon (trademark of a plastic manufactured and sold by Polyplastics), Tenac (trademark of a plastic manufactured and sold by Asahi Chemical Industry, Co., Ltd.) and Derlin (trademark of a plastic manufactured and sold by DuPont), can be preferably used. However, the type of materials for the adjuster A is not limited to the above-mentioned plastics.

Next, explanation is made with regard to how the above-mentioned women's clothing provided with the adjuster A is used in practice.

Initially, after the clothing is put on, the breast cup portions 1, 1' are engaged with each other by means of the inter-cup engaging means 2. To adjust the distance between the breast cup portions 1, 1', the pressing member 40 is pushed, thereby disengaging the first engaging portions 12 and the second engaging portions 22. Illustratively stated, when the pressing member 40 is pushed, the projections 41 in the pressing member 40 are brought into contact with and pressed against the front surfaces 22*c* of the second engaging portions 22, thereby pushing the sliding portion bodies 21. The force applied to the back surfaces of the sliding portion bodies 21 from the engagement maintaining means 30 is smaller than the force applied to the sliding portion bodies 21 from the disengaging means 40. Therefore, the engagement maintaining means 30 is pressed and bent by the pressure applied from the disengaging means 40 through the second engaging portions 22 and the sliding portion bodies 21. Consequently, the engagement maintaining means 30 deforms from the operating position to the non-operating position relative to the sliding portion bodies 21, so that the sliding portion bodies 21 become slidable and is moved to the positions such that the inter-cup distance becomes maximum. Subsequently, the sliding portions 20 are slid inward of the outer casing 10 to desired positions. The second engaging portions 22 engage the first engaging portions 12 while the sliding portions 20 are slid inward of the outer casing 10. However, this engagement between the second engaging portions 22 and the first engaging portions 12 is only temporary, so that the sliding portions 20 can be slid to desired positions without difficulty. After the sliding portions 20 are moved to desired positions, when the wearer releases her hold of the sliding portions 20, the second engaging portions 22 firmly engage the first engaging portions 12 by the engagement maintaining means 30.

Next, explanation is made below with regard to how the women's clothing having the back engaging portions which are capable of rough adjustment is used in practice, with reference to FIGS. 7 to 10. The construction of an adjuster A' employed in this clothing is the same as that of the adjuster A shown in FIGS. 4 to 6 which has already been described above. Therefore, in the following description, the explanation which has been made with respect to the adjuster A is appropriately employed for explaining the construction of the adjuster A'.

Figure 7:
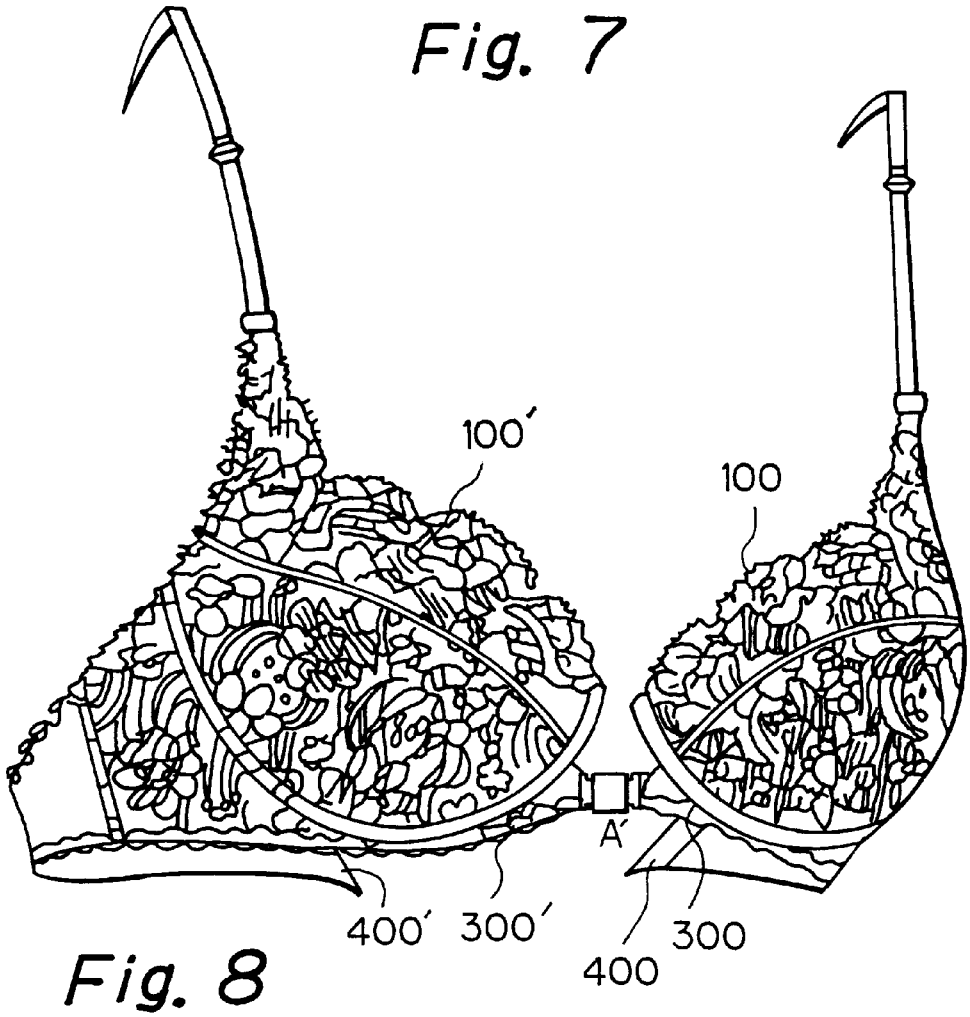
FIG. 7 is a perspective view of a brasserie having back engaging portions provided in the back and an adjuster provided between breast cup portions.
Figure 8:
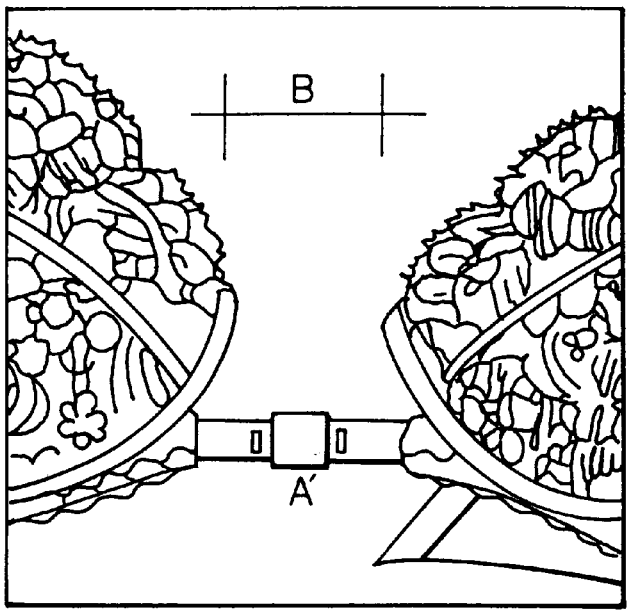
FIG. 8 is a perspective view of a part of the brasserie, in which the inter-cup distance is maintained at a maximum by operating the adjuster.
Figure 9:
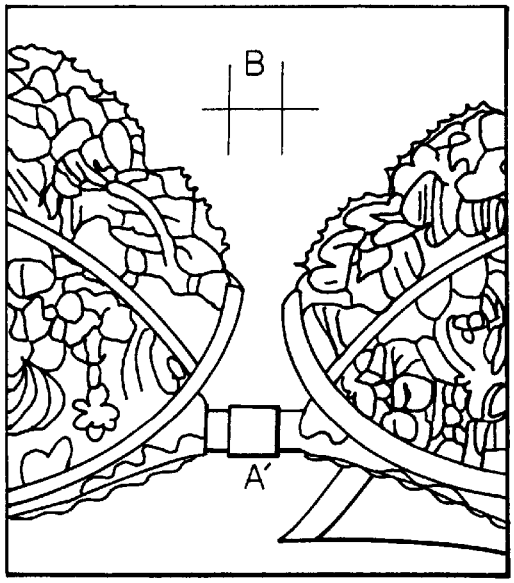
FIG. 9 is another perspective view of a part of the brasserie, in which the inter-cup distance is maintained at a minimum by operating the adjuster.
Figure 10:
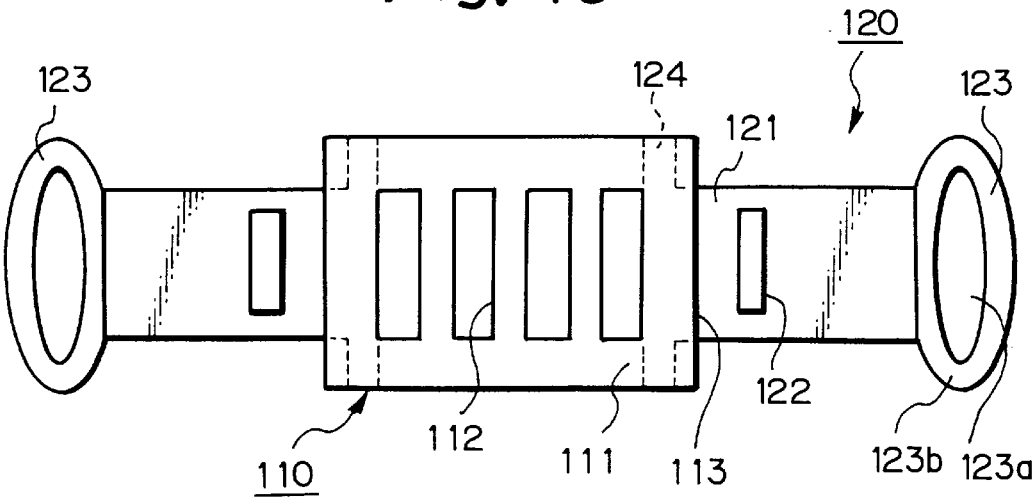
FIG. 10 is a general plan view of the outer casing and the sliding portions of the adjuster, in which the sliding portions are extended to a maximum length with the disengaging means being removed.

FIG. 7 is a perspective view of the brasserie having the back engaging portions provided in the back and the adjuster provided between the breast cup portions. FIG. 8 is a perspective view of a part of the brasserie, in which the inter-cup distance is maintained at a maximum by operating the adjuster. FIG. 9 is another perspective view of a part of the brasserie, in which the inter-cup distance is maintained at a minimum by operating the adjuster. FIG. 10 is a general plan view of the outer casing and the sliding portions of the adjuster, in which the sliding portions are extended to a maximum length with the disengaging means being removed.

The brassiere shown in FIG. 7 comprises a pair of left and right breast cup portions 100, 100', under cup pieces 300, 300' attached to the lower sides of the breast cup portions 100, 100' and back engaging portions 400, 400' which are capable of rough adjustment provided on the back sides of the under cup pieces 300, 300'. The adjuster A' is provided between the breast cup portions 100, 100'. In FIGS. 7 to 9, the adjuster A' is attached to the under cup pieces 300, 300' for ease of attachment. If desired, the adjuster A' may be attached directly to the breast cup portions 100, 100'. The attachment of the adjuster A' can be performed by any suitable technique, such as stitching or bonding, that is conventional in the art. From the viewpoint of preventing the adjuster A' from impairing the aesthetic appeal of the brassiere and from directly contacting with the skin of the wearer to thereby cause discomfort, it is preferred that the adjuster A' be covered with the fabric used in the brassiere and a material having cushioning properties be provided between the wearer's skin and the adjuster A'. The breast cup portions 100, 100' of the brasserie and the under cup pieces 300, 300' are not limited to any particular types and conventional types made of conventional materials will suffice.

The adjuster A' is expandable to the position shown in FIG. 8, where the inter-cup distance B is maximal, and contractable to the position shown in FIG. 9, where the inter-cup distance B is minimal. The adjuster A' can be fixed at any of the specified positions between the two extreme positions. In the case under consideration, the inter-cup distance B is set to range from a maximal 35 mm to a minimal 20 mm. However, this is not the sole case of the invention and various maximal and minimal values can be adopted depending upon the type of women's clothing provided with the adjuster A', its use, bust size and other factors.

The construction of the adjuster A' is substantially the same as that of the adjuster A shown in FIGS. 4 to 6, except that the construction of connecting portions of the sliding portion bodies is slightly changed. Therefore, with respect to the construction of the adjuster A', explanation is made primarily on the change in construction of the connecting portions, with reference to FIG. 10, instead of explaining the construction of the adjuster A' in detail. In the adjuster A' shown in FIG. 10, for designating parts or portions corresponding the parts or portions of the adjuster A shown in FIGS. 4 to 6, use is made of reference numerals which are obtained by adding one hundred to each of the reference numerals for the corresponding parts or portions in FIGS. 4 to 6.

The adjuster A' comprises an outer casing 110 and a pair of sliding portions 120 attached to the breast cup portions 100, 100', respectively. As shown in FIG. 10, the sliding portions 120 comprise sliding portion bodies 121, second engaging portions 122 provided in the sliding portion bodies 121 and engagable with first engaging portions 112, connecting portions 123 adapted to be connected to the breast cup portions 100, 100' or the under cup pieces 300, 300' and stoppers 124 provided at leading end portions of the sliding portion bodies 121.

Each of the connecting portions 123 is shaped as a closed ring having a central opening 123*a* for ease of attachment to the breast cup portions 100, 100' or the under cup pieces 300, 300'. The connecting portions 123 are made flat in order to prevent them from forming "bumps" when connected to the breast cup portions 100, 100' or the under cup pieces 300, 300'. The connecting portions 123 have hold portions 123*b*. In order to slide the sliding portions 120 outward of the outer casing 110, the wearer can hold the hold portions 123*b* with her fingers and operate the sliding portions 120.

Hereinbelow, explanation is made with regard to how the above-mentioned women's clothing provided with the adjuster and the back engaging portions is used in practice.

Initially, after the clothing is put on, the back engaging portions are engaged with each other. Subsequently, the pressing member 140 is pushed, so that the sliding portions 120 become slidable in the same manner as mentioned in connection with the sliding portions 20 in the adjuster A. The sliding portions 120 are moved to positions such that the inter-cup distance is maximal. Next, the sliding portions 120 are manually pushed from opposite sides with respect to the adjuster A', to thereby slide the sliding portions 120 inward of the outer casing 110. When the sliding portions 120 are moved to suitable positions in accordance with the wearer's bust shape or, if desired, positions which provide a desired "push-up" effect, the wearer keeps her fingers off the sliding portions 120, so that the second engaging portions 122 of the sliding portions 120 are fitted in the first engaging portions 112 of the outer casing 110. Simultaneously with the fitting of the second engaging portions 122 in the first engaging portions 112, the sliding portions 120 are pressed by the engagement maintaining means 130, to thereby maintain the engagement between the first engaging portions 112 and the second engaging portions 122. To re-adjust the inter-cup distance, the disengaging means 140 is manually pushed again, so that the sliding portions 120 and the engagement maintaining means 130 are pressed, thereby disengaging the first engaging portions 112 and the second engaging portions 122. Consequently, the sliding portions 120 become slidable and then, the above-mentioned operation for adjusting the inter-cup distance to a desired level by fitting the second engaging portions 122 in the first engaging portions 112 is repeated.

While the above-mentioned embodiments concern the common brassiere, the present invention is not limited to those embodiments and may be applied to various articles of women's clothing having the breast cup portions, such as slips, body suits, camisoles, swimsuits and leotards. The breast cup portions may or may not have wires, and may or may not have straps. If the invention is applied to a brassiere having wires in the breast cup portions, the bust supporting function of the wires will add to the effectiveness of the invention in providing a "good fit" to the bust shape of the wearer. If the invention is applied to a conventional strapless brassiere, its bust supporting capability is further enhanced. The invention may also be applied to a padded brassiere, providing a greater "push-up" effect.

In the present invention, the adjuster is in no way limited to the embodiments described above and various modifications may be made. For example, the means for achieving engagement between the outer casing and the sliding portions may be replaced by a rack-and-pinion mechanism or a gear mechanism.

Unlike the conventional women's clothing having breast cup portions, the women's clothing of the present invention enables the wearer to make fine adjustments of the distance between breast cup portions in accordance with her own bust shape either when the clothing is being put on or after the clothing is put on. If the breast cup portions are brought close to the center of the bust, not only a "good fit" but also a desired "push-up" effect can be attained.

An even greater "push-up" effect can be achieved if the adjuster is attached to an article of women's clothing having breast cup portions that are equipped with pads or other members to provide the "push-up" effect.

What is claimed is:

1. Women's clothing having a pair of left and right breast cup portions for covering the breasts, wherein an adjuster is provided between said breast cup portions for adjusting the distance between said breast cup portions, said adjuster comprising:

an outer casing having at least one first engaging portion;

a pair of sliding members slid into said outer casing and engageable with said outer casing, said pair of sliding members each including a second engaging portion engageable in a stepwise manner with said first engaging portion;

at least one engagement maintaining device provided on said outer casing for maintaining engagement between said pair of sliding members and said outer casing, said engagement maintaining device being deformable between an operating position where it presses said first and second engaging portions against each other to secure the engagement therebetween and a non-operating position where it allows said first and second engaging portions to disengage from each other; and at least one disengaging device for disengaging said pair of sliding members individually from said outer casing, said disengaging device being provided on said outer casing and movable to cause said engagement maintaining device to deform between said operating position and said non-operating position.

2. The women's clothing according to claim 1, wherein said pair of sliding members are connected respectively to said pair of left and right breast cup portions.

3. The women's clothing according to claim 1, wherein one of said sliding members is secured to one of said breast cup portions, and the other of said sliding members is detachably connected to the other of said breast cup portions.

4. The women's clothing according to claim 1, further comprising a back adjuster provided in the back of said clothing for length adjustment in order for said clothing to fit around the external rib case of a wearer, wherein said adjuster provides a greater degree of adjustability than said back adjuster and is operated when the clothing is being put on or after the clothing is put on.

5. The women's clothing according to claim 1, wherein said disengaging means is a pressing member which covers said outer casing.

6. Women's clothing having a pair of left and right breast cup portions for covering the breasts, wherein an adjuster is provided between said breast cup portions for adjusting the distance between said breast cup potions, said adjuster comprising:

an outer casing having at least one first engaging portion;

a pair of sliding members contained in said outer casing and each comprising a second engaging portion engageable in a stepwise manner with said first engaging portion of said outer casing, said pair of sliding members being connected respectively to said pair of left and right breast cup portions;

at least one engagement maintaining device for maintaining engagement between said pair of sliding members and said outer casing; and at least one disengaging device for disengaging said pair of sliding members from said outer casing, wherein said disengaging device disengages both of said second engaging portions simultaneously from said first engaging portion.

7. The women's clothing according to claim 6, wherein said disengaging device disengages said second engaging portions individually from said first engaging portion.

8. The women's clothing according to claim 6, wherein said disengaging device is a pressing member which covers said outer casing.

9. The women's clothing according to claim 6, wherein each of said sliding members has a stopper for preventing separation of said sliding members from said outer casing.

10. An adjuster for adjusting the distance between a pair of left and right breast cup portions, comprising:

an outer casing having at least one first engaging portion;

a pair of sliding members slid into said outer casing and engageable with said outer casing, said pair of sliding members each including a second engaging portion engageable in a stepwise manner with said first engaging portion;

at least one engagement maintaining device provided on said outer casing for maintaining engagement between said pair of sliding members and said outer casing, said engagement maintaining device being deformable between an operating position where it presses said first and second engaging portions against each other to secure the engagement therebetween and a non-operating position where it allows said first and second engaging portions to disengage from each other; and at least one disengaging device for disengaging said pair of sliding members individually from said outer casing, said disengaging device being provided on said outer casing and movable to cause said engagement maintaining device to deform between said operating position and said non-operating position.

11. The adjuster according to claim 10, wherein one of said first and second engaging portions includes a plurality of engaging ribs each engageable with the other engaging portion for length adjustment between said sliding members.

12. The adjuster according to claim 10, wherein said disengaging device is a pressing member which covers said outer casing, wherein said pressing member disengages both of said sliding member, simultaneously from said outer casing.

* * * * *